US007850232B2

(12) United States Patent
Casteel

(10) Patent No.: US 7,850,232 B2
(45) Date of Patent: Dec. 14, 2010

(54) ZERO CLEARANCE RECLINER MECHANISM

(75) Inventor: Richard E. Casteel, New Albany, MS (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 346 days.

(21) Appl. No.: 11/827,124

(22) Filed: Jul. 10, 2007

(65) Prior Publication Data

US 2008/0217975 A1 Sep. 11, 2008

Related U.S. Application Data

(60) Provisional application No. 60/894,138, filed on Mar. 9, 2007.

(51) Int. Cl.
*A47C 1/032* (2006.01)

(52) U.S. Cl. ..... 297/85 L; 297/68

(58) Field of Classification Search ..... 297/68, 297/83, 85 L

See application file for complete search history.

(56) References Cited

U.S. PATENT DOCUMENTS

| | | | |
|---|---|---|---|
| 3,582,135 | A | 6/1971 | Fletcher |
| 3,743,348 | A | 7/1973 | Sloan |
| 3,756,651 | A | 9/1973 | Sloan |
| 3,767,257 | A | 10/1973 | Rogers, Jr. et al. |
| 3,768,859 | A | 10/1973 | Rogers, Jr. et al. |
| 3,790,211 | A | 2/1974 | Caldwell |
| 3,813,150 | A | 5/1974 | Katz et al. |
| 3,815,954 | A | 6/1974 | Rogers et al. |
| 3,819,229 | A | 6/1974 | Rogers et al. |
| 3,858,932 | A | 1/1975 | Crum et al. |
| 3,869,169 | A | 3/1975 | Johnson et al. |
| 3,904,240 | A | 9/1975 | Rogers et al. |
| 3,926,472 | A | 12/1975 | Evans |
| 3,937,518 | A | 2/1976 | Harrison |
| 3,942,835 | A | 3/1976 | Harrison |
| 4,007,960 | A | 2/1977 | Gaffney |
| 4,071,275 | A | 1/1978 | Rogers |
| 4,099,776 | A | 7/1978 | Crum et al. |
| 4,108,491 | A | 8/1978 | Rogers |
| 4,113,305 | A | 9/1978 | Hampton |
| 4,185,869 | A | 1/1980 | Rogers |

(Continued)

FOREIGN PATENT DOCUMENTS

WO WO2006/026199 A1 3/2006

*Primary Examiner*—Anthony D Barfield
(74) *Attorney, Agent, or Firm*—Patterson Thuente Christensen Pedersen, P.A.

(57) ABSTRACT

A reclining chair includes a seat, a backrest, and a pair of spaced apart recliner mechanisms cooperatively supporting the seat and backrest. Each of the mechanisms includes a ground engaging base link, a seat link operably coupled with and supporting the seat, a backrest linkage operably coupling the backrest to the seat link, a rear swing link operably coupled to the base link at a first pivot, and a front swing link operably coupled to the base link with a shiftable pivot mechanism defining a second pivot. The rear swing link and the front swing link are selectively pivotable about the first and second pivots respectively to enable the mechanism to be selectively shifted between an upright position and a reclined position. The shiftable pivot mechanism shifts a position of the second pivot relative to the base link as the mechanism shifts between the first position and the second position.

20 Claims, 14 Drawing Sheets

U.S. PATENT DOCUMENTS 4,188,062 A 2/1980 Rogers et al.
4,194,783 A 3/1980 Cycowicz et al.
4,216,992 A 8/1980 Crum
4,226,468 A 10/1980 Johnson
4,247,146 A 1/1981 Cycowicz et al.
4,249,772 A 2/1981 Rogers
4,291,913 A 9/1981 Kowalski
4,306,746 A 12/1981 Crum
4,319,780 A 3/1982 Rogers
4,337,977 A 7/1982 Rogers et al.
4,350,386 A 9/1982 Rogers
4,350,387 A 9/1982 Rogers
4,352,523 A 10/1982 Holobaugh, Jr.
4,357,049 A 11/1982 Rogers et al.
4,364,603 A 12/1982 Johnson
4,408,796 A 10/1983 Mizelle
4,418,957 A 12/1983 Rogers
4,423,903 A 1/1984 Gerth
4,506,925 A 3/1985 Crum
4,519,647 A 5/1985 Rogers
4,531,778 A 7/1985 Rogers
4,536,029 A 8/1985 Rogers
4,544,201 A 10/1985 Rogers
4,570,996 A 2/1986 Rogers
4,577,902 A 3/1986 Crum
4,591,205 A 5/1986 James
4,662,673 A 5/1987 Crum
4,669,778 A 6/1987 Rogers
4,674,794 A 6/1987 Pine
4,681,365 A 7/1987 Pine
4,690,454 A 9/1987 Mizelle
4,707,025 A 11/1987 Rogers
4,718,716 A 1/1988 Stumpf et al.
4,721,835 A 1/1988 Welker
4,740,031 A 4/1988 Rogers
4,805,960 A 2/1989 Tacker
4,815,788 A * 3/1989 May ..... 297/68 X
4,826,243 A 5/1989 Lawson
4,844,536 A 7/1989 Mizelle
4,861,101 A 8/1989 Hartline
4,863,215 A 9/1989 Crum
4,878,710 A 11/1989 Tacker
4,895,411 A 1/1990 Pine
4,904,019 A 2/1990 May
4,915,444 A 4/1990 Rogers
4,919,478 A 4/1990 Tacker
4,989,914 A 2/1991 Pine
5,000,510 A 3/1991 Lafer
5,007,679 A 4/1991 Mizelle
5,011,220 A 4/1991 LaPointe
5,013,084 A 5/1991 May
5,015,031 A 5/1991 Horenkamp
RE33,704 E 10/1991 Rogers
5,054,850 A 10/1991 Pine
5,072,988 A 12/1991 Plunk
5,087,094 A 2/1992 Rogers
5,088,789 A 2/1992 LaPointe et al.
5,090,768 A 2/1992 Re
5,110,179 A 5/1992 Rogers
5,120,107 A 6/1992 Rogers
5,121,966 A 6/1992 Tischler
5,121,967 A 6/1992 Rogers
5,129,701 A 7/1992 Pine
5,137,328 A 8/1992 Smith et al.
5,141,284 A 8/1992 LaPointe
5,156,441 A 10/1992 Byersmith et al.
5,169,208 A 12/1992 Re
5,171,000 A 12/1992 LaPointe et al.
5,186,518 A 2/1993 Pine
5,192,113 A 3/1993 Wiecek
5,217,276 A 6/1993 LaPointe et al.
5,246,266 A 9/1993 Ostergaard
5,271,660 A 12/1993 LaPointe et al.
5,292,170 A 3/1994 LaPointe et al.
5,312,153 A 5/1994 Lin
RE34,666 E 7/1994 Tacker
5,348,367 A 9/1994 Mizelle
5,354,116 A 10/1994 May et al.
5,360,255 A 11/1994 Cook
5,370,442 A 12/1994 Saul
5,374,101 A 12/1994 Wiecek
5,382,073 A 1/1995 Habegger et al.
5,388,886 A 2/1995 LaPointe
5,419,611 A 5/1995 Cook
5,423,591 A 6/1995 LaPointe
5,427,431 A 6/1995 Saul et al.
5,480,209 A 1/1996 May
5,485,979 A 1/1996 LaPointe
5,527,092 A 6/1996 Cook et al.
5,556,158 A 9/1996 Wiecek
5,570,927 A 11/1996 LaPointe
5,582,457 A 12/1996 Komorowski
5,588,710 A 12/1996 Wiecek
5,636,898 A 6/1997 Dixon et al.
5,695,239 A 12/1997 Johnson
5,704,686 A 1/1998 May
5,765,914 A 6/1998 Britain et al.
5,772,278 A 6/1998 Kowalski
5,772,282 A 6/1998 Stumpf et al.
5,775,775 A 7/1998 Hoffman
5,795,021 A 8/1998 Rogers
5,800,010 A 9/1998 May
5,810,431 A 9/1998 Gibson
5,823,614 A 10/1998 Johnson et al.
5,845,961 A 12/1998 LaPointe
5,876,094 A 3/1999 Hoffman
5,954,392 A 9/1999 Liss
5,971,475 A 10/1999 Lawson et al.
5,975,627 A 11/1999 LaPointe
5,992,930 A 11/1999 LaPointe et al.
6,000,754 A 12/1999 Lawson
6,000,756 A 12/1999 Hybarger et al.
6,010,189 A 1/2000 Hybarger et al.
6,059,367 A 5/2000 Rogers
6,061,891 A 5/2000 Hoffman
6,109,694 A 8/2000 Kurtz
6,142,558 A 11/2000 May
6,145,924 A 11/2000 Mero
6,168,232 B1 1/2001 May
6,231,120 B1 5/2001 Wiecek
6,250,715 B1 6/2001 Caruso et al.
6,409,262 B1 6/2002 LaPointe
6,491,342 B1 12/2002 Smith
6,540,291 B2 4/2003 Hoffman et al.
6,609,755 B2 8/2003 Koepke et al.
6,634,706 B2 10/2003 May
6,655,732 B1 12/2003 LaPointe
6,659,556 B2 12/2003 Pellerin
6,692,078 B2 2/2004 Pham et al.
6,729,686 B2 5/2004 May
6,739,650 B2 5/2004 Bartlett
6,769,734 B2 8/2004 Tacker
6,789,852 B1 9/2004 Hwang
6,862,777 B2 3/2005 LaPointe
7,413,245 B2 * 8/2008 Johnson et al. ..... 297/85 L
2001/0035668 A1 11/2001 Gaffney et al.
2002/0063459 A1 5/2002 Gaffney et al.
2002/0125746 A1 9/2002 Gaffney et al.
2003/0015893 A1 1/2003 Hoffman et al.
2003/0057742 A1 3/2003 May
2003/0057743 A1 3/2003 May
2003/0075965 A1 4/2003 Pham et al.
2003/0193219 A1 10/2003 Garland
2004/0051350 A1 3/2004 Duncan et al.

2004/0195881 A1 10/2004 Wells
2005/0023869 A1 2/2005 Longnecker
2005/0067867 A1 3/2005 May
2005/0104420 A1 5/2005 Murphy

* cited by examiner

ZERO CLEARANCE RECLINER MECHANISM

RELATED APPLICATIONS

This application claims the benefit of U.S. Provisional Application No. 60/894,138 entitled ZERO CLEARANCE RECLINER MECHANISM filed Mar. 9, 2007, said application hereby fully incorporated herein by reference.

FIELD OF THE INVENTION

The present invention relates to reclining chair mechanisms and more specifically to zero-clearance reclining chair mechanisms.

BACKGROUND OF THE INVENTION

Reclining chairs have become a very popular furniture item in today's home. Modern reclining chairs generally define three discrete seating positions: (1) an upright position in which the back is generally proximate a perpendicular orientation relative to the seat and the ottoman (if the chair is so equipped) is retracted; (2) a "TV" position in which the ottoman is extended, but the back is still more or less upright relative to the seat; and (3) a fully reclined position in which the ottoman is extended and the back is inclined at a greater angle relative to the seat.

A drawback of standard reclining chairs, however, is that they must be positioned at some distance from the wall of a room because the top of the backrest tilts in a rearward direction when the chair is reclined. Prior attempts have been made to address this rear clearance problem existing with standard reclining chairs. These attempts have resulted in a general class of recliner mechanisms known as "zero-clearance" mechanisms, wherein linkages or other elements are arranged so that the lower edge of the backrest and the chair seat shifts forward relative to the floor as the mechanism is reclined, thereby enabling a lesser rearward shift of the top edge of the backrest. Examples of such prior mechanisms are disclosed in U.S. Pat. Nos. 4,740,031; 5,011,220; 5,570,927; 5,588,710; 5,772,278 and 5,217,276, all hereby incorporated herein by reference.

One type of zero-clearance mechanism generally includes a four-bar linkage, wherein a pair of spaced apart swing links are pivoted on a base at one end of each link and pivoted to a seat link at the other ends. As the chair is reclined from the upright position in which the seat link is positioned over the base, the swing links pivot about their connections with the base to shift the seat link forwardly relative to the base. This in turn shifts the entirety of the backrest forwardly, away from any wall that may be behind the chair. These linkage based mechanisms are popular and in widespread use due to their low cost and relative ease of manufacture.

It is usually desirable for user comfort purposes, however, for the seat to slope rearwardly toward the backrest of the chair. This is typically implemented in the linkage based mechanisms by making the front swing link longer than the rear swing link. A consequence, however, is that a user sitting in the chair is usually forced to work against the mechanism to shift the chair from the upright to the reclined positions and vice versa, particularly immediately proximate the upright position. The difference in length between the front and rear swing links cannot be made too great without resulting in excessively high user effort to operate the chair. Since the degree of forward shifting of the seat and backrest depends at least in part on the length of the swing links, the extent to which such a mechanism can approach true "zero-clearance" is limited. As a result, prior linkage type zero-clearance mechanisms still generally require some degree of rear clearance behind the backrest, because the top of the backrest still shifts rearwardly to some degree when the chair is reclined.

Hence, what is still needed in the industry is a low cost, easy to operate recliner chair that enables less rear clearance than known "zero-clearance" mechanisms.

SUMMARY OF THE INVENTION

The mechanism of the present invention addresses the need of the industry for a low cost, easy to operate recliner chair that enables less rear clearance than known "zero-clearance" mechanisms. In an embodiment of the invention, a reclining chair includes a seat, a backrest, and a pair of spaced apart recliner mechanisms cooperatively supporting the seat and backrest. Each of the mechanisms includes a ground engaging base link, a seat link operably coupled with and supporting the seat, a backrest linkage operably coupling the backrest to the seat link, a rear swing link operably coupled to the base link at a first pivot, and a front swing link operably coupled to the base link with a shiftable pivot mechanism defining a second pivot. The rear swing link and the front swing link are operably coupled to the seat link and the backrest linkage. The rear swing link and the front swing link are selectively pivotable about the first and second pivots respectively to enable the mechanism to be selectively shifted between an upright position in which the seat is disposed in a first position relative to the base link and the backrest defines a first angle relative to the seat, and a reclined position in which the seat is disposed in a second position forward of the first position relative to the base link and the backrest defines a second angle greater than the first angle relative to the seat. The shiftable pivot mechanism shifts a position of the second pivot relative to the base link as the mechanism shifts between the first position and the second position.

In an embodiment, the shiftable pivot mechanism includes a follower post on the front swing link and a slot defined in the base link, wherein the follower post is received and slidably shiftable in the slot. In a further embodiment, the shiftable pivot mechanism may be a linkage operably coupling the front link and the base link. The chair may further be positionable in a third position, corresponding to a "TV" position, intermediate the first position and the second positions.

A mechanism according to embodiments of the invention may include an ottoman linkage operably coupled to the seat link, wherein the ottoman linkage is selectively shiftable between a retracted position corresponding with the upright position of the mechanism, and an extended position corresponding with the reclined position of the mechanism. A drive linkage operably coupled with the ottoman linkage may be provided for selectively shifting the ottoman linkage between the retracted position and the extended position.

An embodiment of a chair according to the invention may include a seat, a backrest, and a pair of spaced apart recliner mechanisms cooperatively supporting the seat and backrest. Each mechanism includes a ground engaging base link, a seat link operably coupled with and supporting the seat, a backrest linkage operably coupling the backrest to the seat link, a rear swing link operably coupled to the base link at a first pivot, a front swing link, and means for pivotally coupling the front swing link to the base link. The means may include means for defining a second pivot about which the front swing link is selectively pivotable, and means for shifting a position of the second pivot relative to the base link. The rear swing link and the front swing link are operably coupled to the seat link and the backrest linkage, wherein the rear swing link and the front swing link are selectively pivotable about the first and second pivots respectively to enable the mechanism to be selectively shifted between an upright position in which the seat is disposed in a first position relative to the base link and the backrest defines a first angle relative to the seat, and a reclined position in which the seat is disposed in a second position forward of the first position relative to the base link and the backrest defines a second angle greater than the first angle relative to the seat, and wherein the position of the second pivot is shifted relative to the base link as the mechanism shifts between the first position and the second position.

In an embodiment, the means for defining a second pivot about which the front swing link is selectively pivotable may include a follower post on the front swing link, and the means for shifting a position of the second pivot may include a slot defined in the base link, the follower post received and slidably shiftable in the slot. In a further embodiment, the means for defining a second pivot about which the front swing link is selectively pivotable and the means for shifting a position of the second pivot may include a crank or other linkage pivotally coupled to the base link and the front swing link.

A zero-clearance mechanism for a reclining chair according to an embodiment of the invention includes a ground engaging base link, a seat link, a backrest linkage comprising a backrest bracket, a rear swing link operably coupled to the base link at a first pivot, and a front swing link operably coupled to the base link with a shiftable pivot mechanism defining a second pivot. The rear swing link and the front swing link are operably coupled to the seat link and the backrest linkage, wherein the rear swing link and the front swing link are selectively pivotable about the first and second pivots respectively to enable the mechanism to be selectively shifted between an upright position in which the seat link is disposed in a first position relative to the base link and the backrest bracket defines a first angle relative to the seat, and a reclined position in which the seat link is disposed in a second position forward of the first position relative to the base link and the backrest bracket defines a second angle greater than the first angle relative to the seat link, The shiftable pivot mechanism shifts a position of the second pivot relative to the base link as the mechanism shifts between the first position and the second position.

DETAILED DESCRIPTION OF THE PREFERRED EMBODIMENTS

Figure 1:
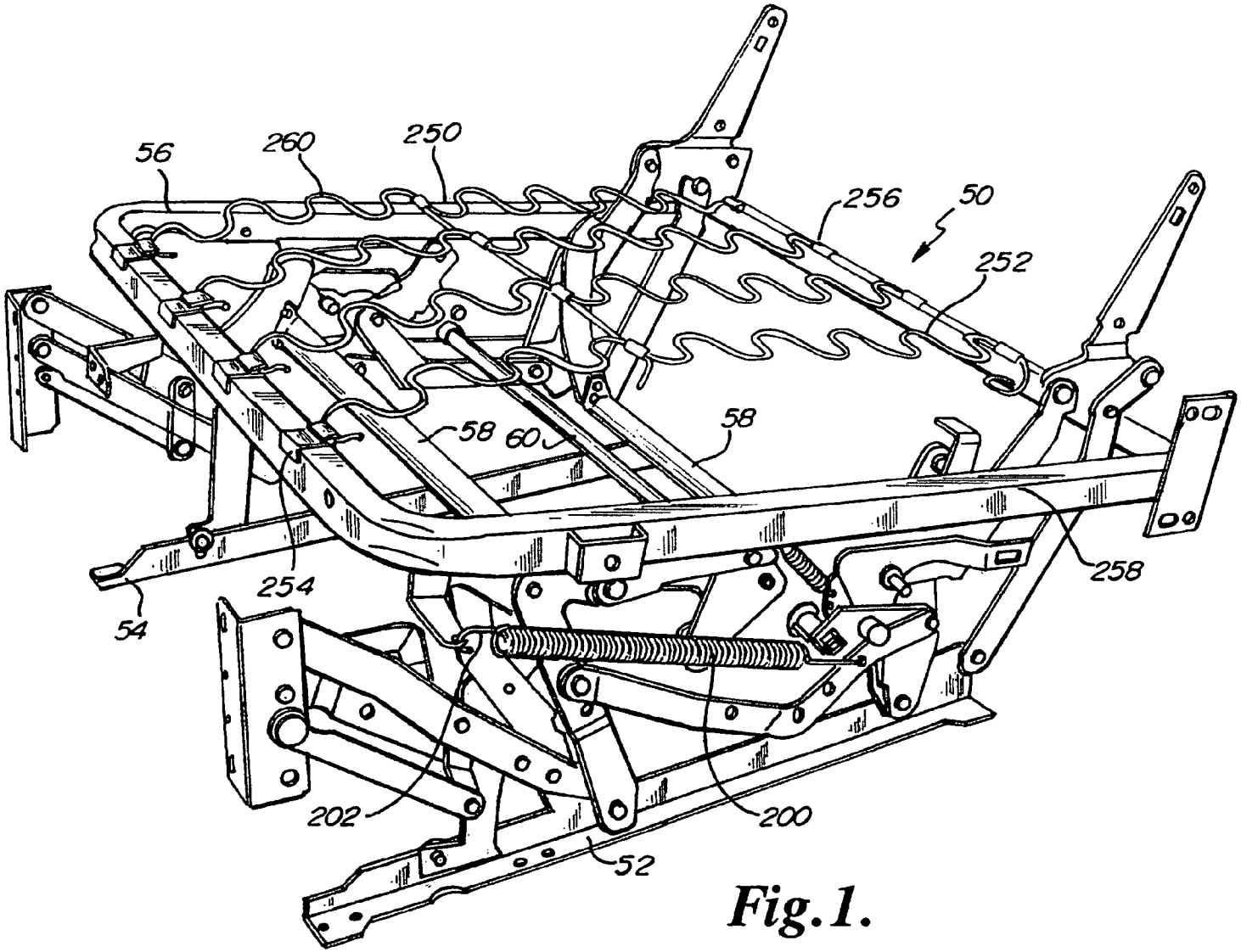
FIG. 1 is a perspective view of a recliner mechanism according to an embodiment of the invention.
Figure 1A:
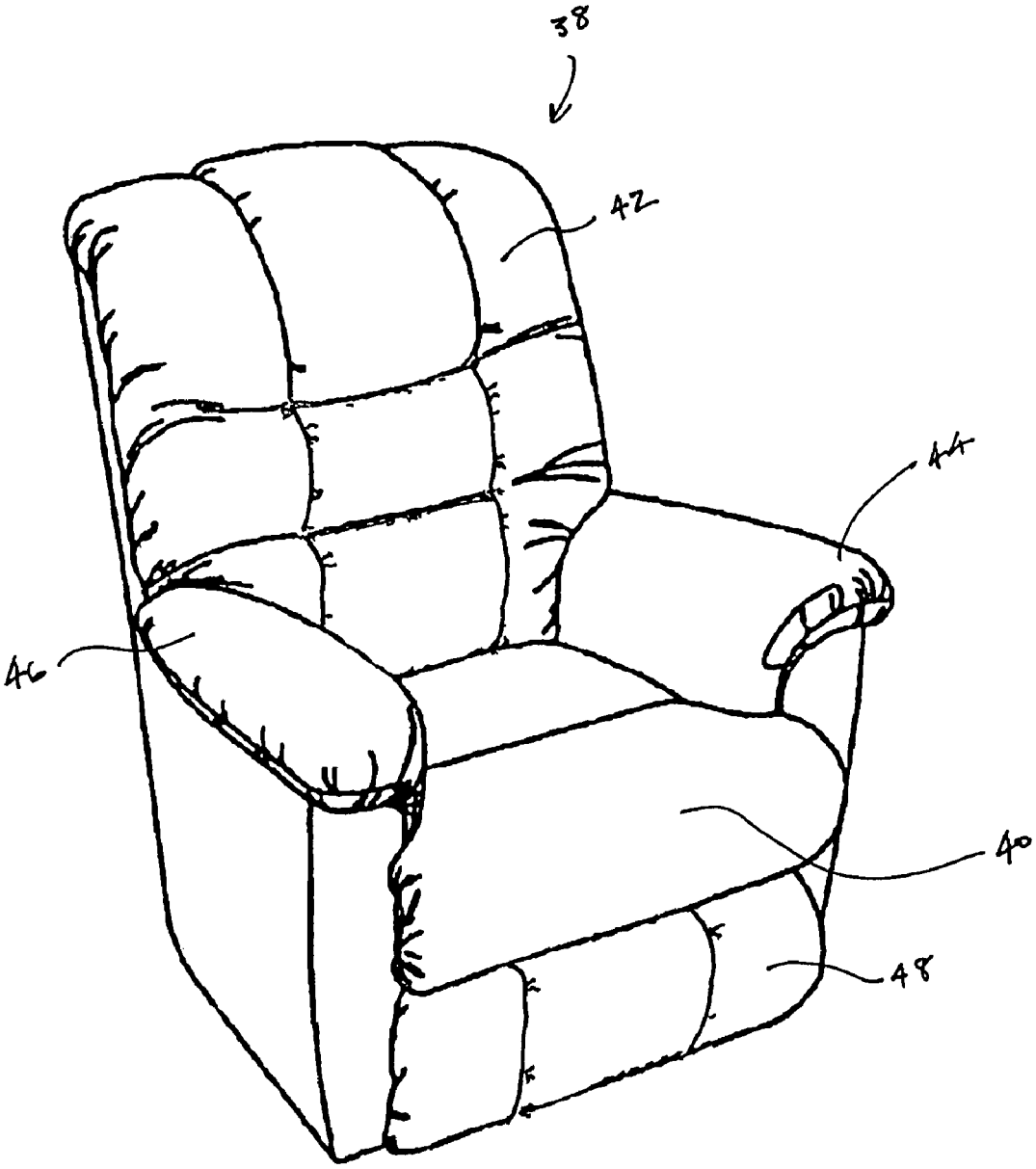
FIG. 1*a* is a perspective view of a recliner chair according to an embodiment of the invention.
Figure 2:
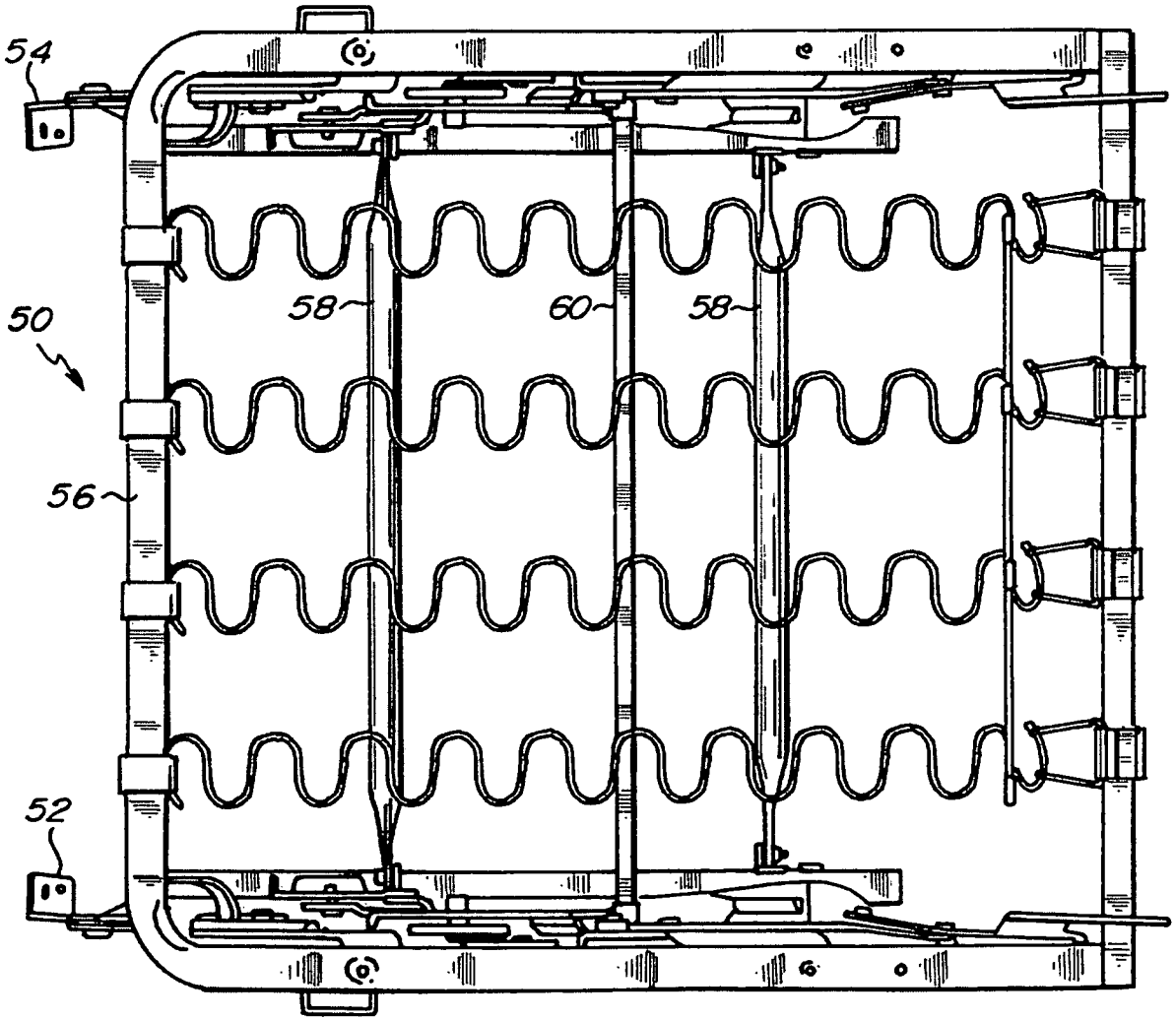
FIG. 2 is a top plan view of the recliner mechanism of FIG. 1.
Figure 3:
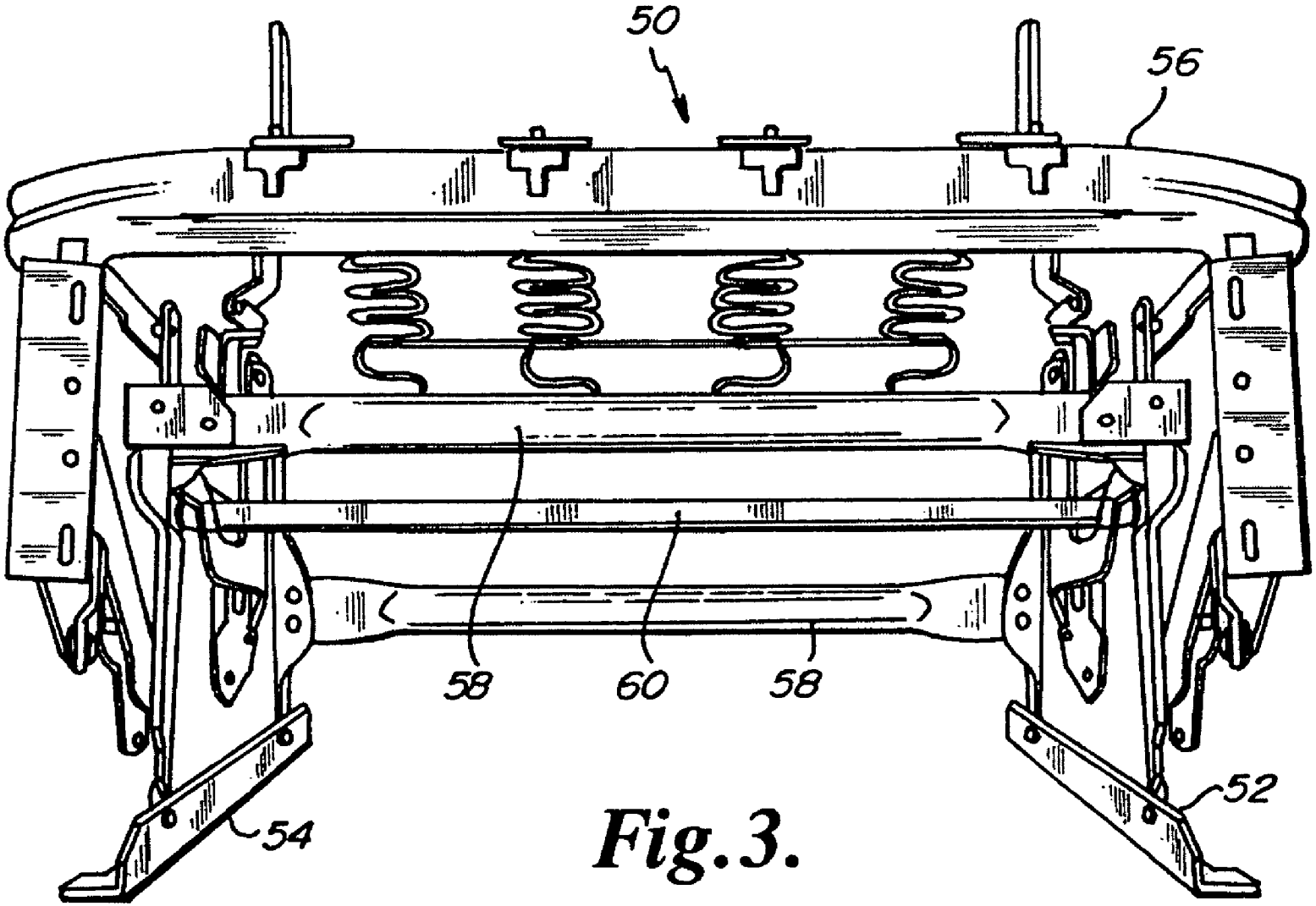
FIG. 3 is a front elevation view of the recliner mechanism of FIG. 1.
Figure 4:
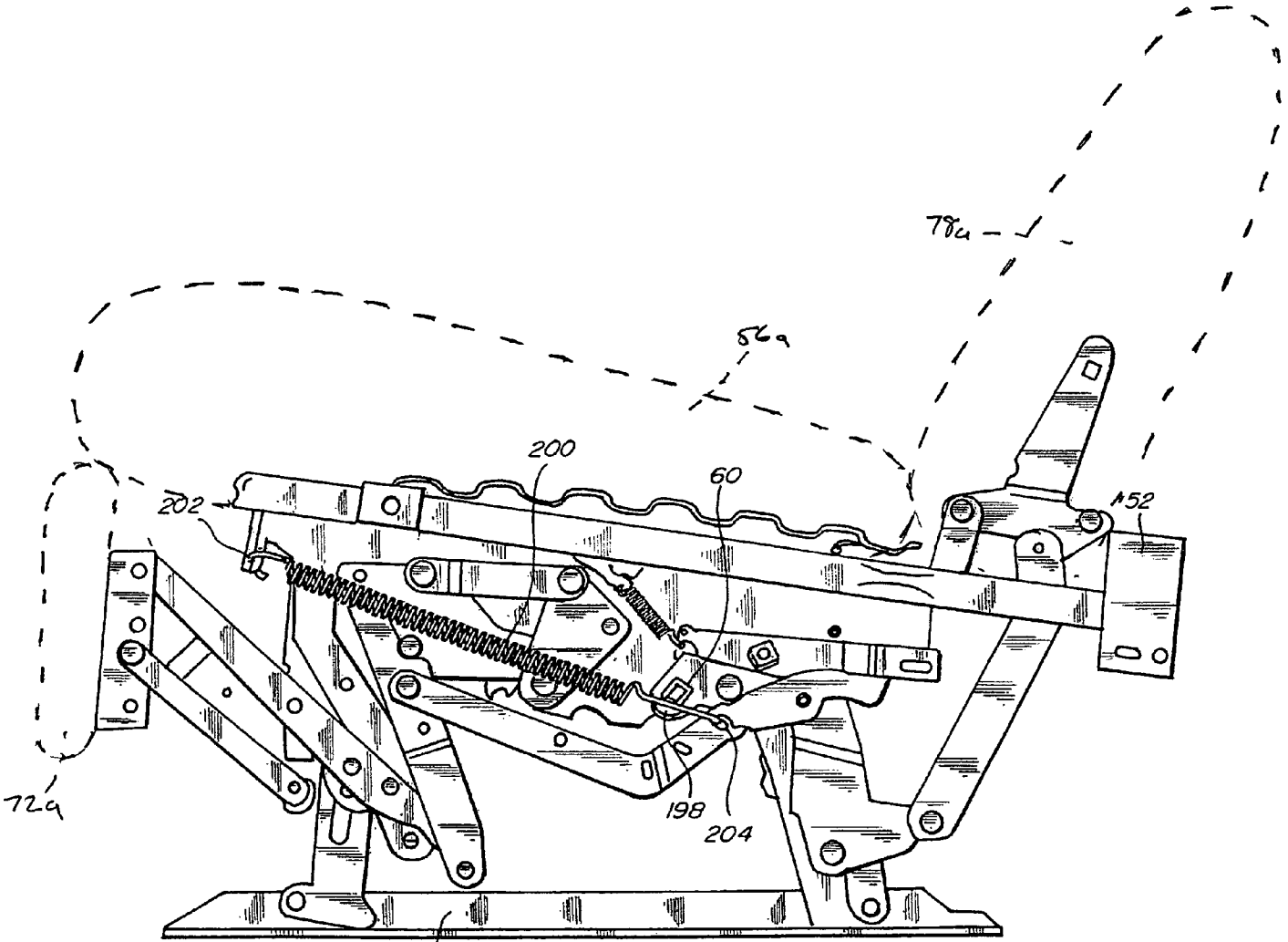
FIG. 4 is a side elevation view of the recliner mechanism of FIG. 1.
Figure 5:
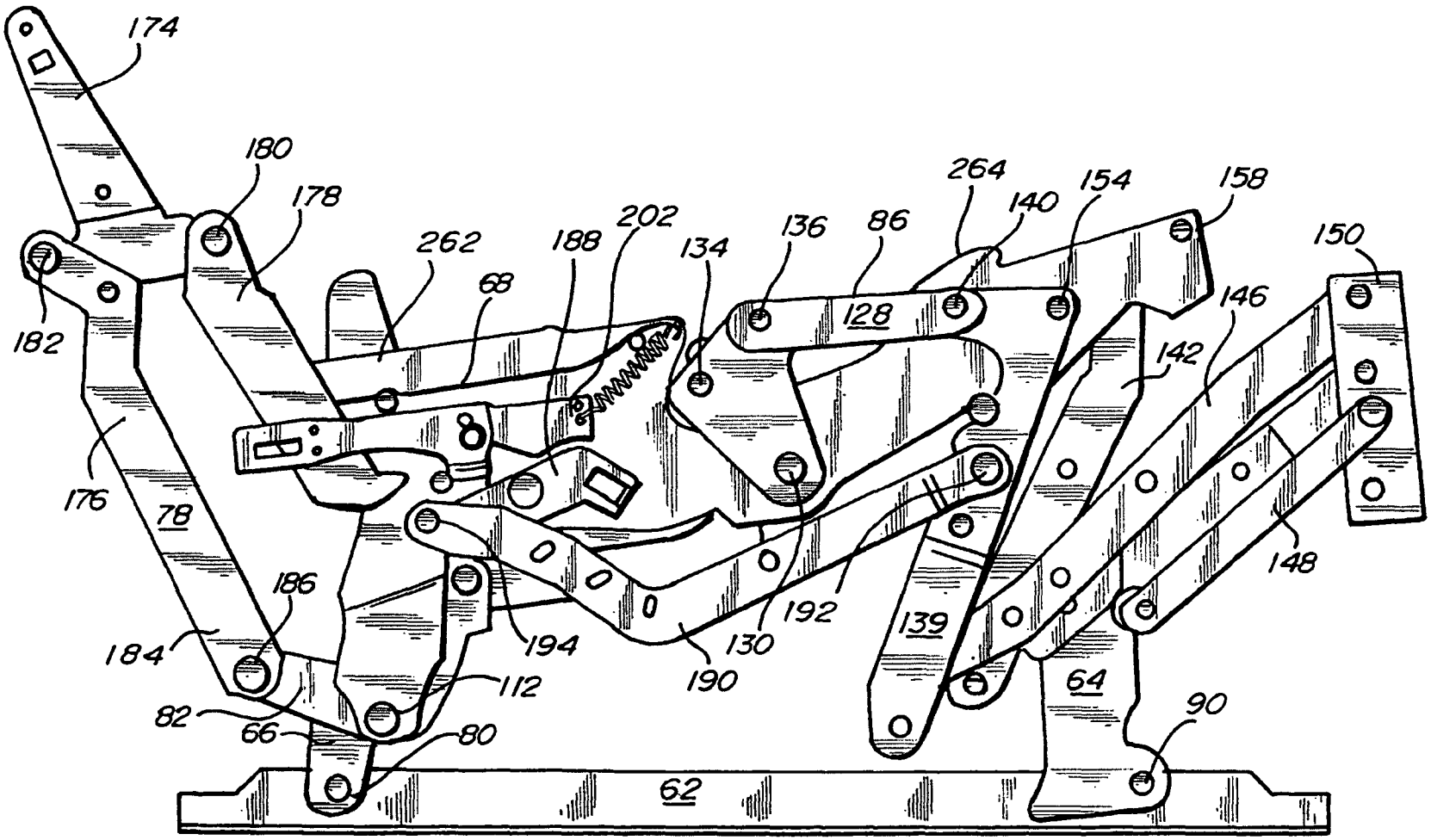
FIG. 5 is an inside elevation view of a linkage of the recliner mechanism of FIG. 1, positioned in an upright position.
Figure 6:
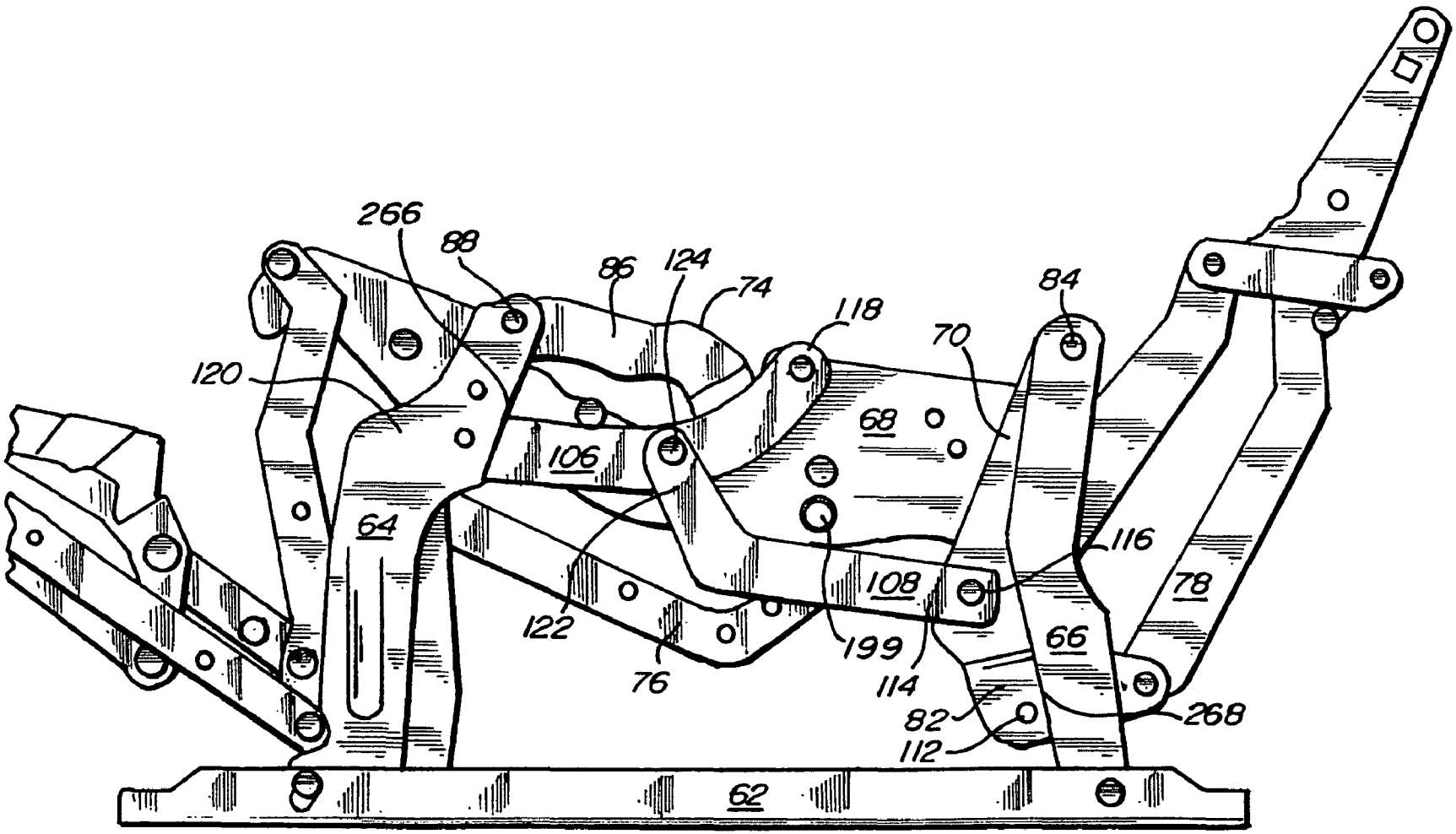
FIG. 6 is an outside elevation view of a linkage of the recliner mechanism of FIG. 1, positioned in an upright position.

As depicted in FIGS. 1 and 1*a*, zero-clearance recliner chair 38 generally includes seat 40, backrest 42, arms 44, 46, and ottoman 48, all operably coupled with mechanism 50. Mechanism 50 generally includes a pair of linkages 52, 54, seat box 56, cross-bracing 58, and crankshaft 60. Linkages 52, 54, are mirror images of each other and have identical structure and function. As a result, the description provided herein below for linkage 52 should be assumed to apply also to linkage 54.

Linkage 52 generally includes ground-engaging base link 62, front swing link 64, rear swing link 66, seat link 68, lower coordinating linkage 70, ottoman linkage 72, upper coordinating linkage 74, drive linkage 76, and backrest linkage 78. Rear swing link 66 is pivotally connected to base link 62 at pivot 80 and to bell crank 82 of lower coordinating linkage 70 at pivot 84. Front swing link 64 is pivotally connected to upper link 86 of upper coordinating linkage 74 at pivot 88. Front swing link 64 is coupled to base link 62 with follower post 90 slidably disposed in slot 92. Bottom end 94 of front swing link 64 has offset portions 96, 98, on either side of longitudinal axis 100, with follower post 90 disposed on offset portion 96 so as to be offset from longitudinal axis 100. Bottom edge 102 of front swing link 64 has rounded corner 104 at the rear.

Lower coordinating linkage 70, in addition to bell crank 82, generally includes front link 106 and tie bar 108. Bell crank 82 is pivotally connected to lower extension 110 of seat link 68 at pivot 112. Rear end 114 of tie bar 108 is pivotally connected to bell crank 82 at pivot 116. Front link 106 is pivotally connected to seat link 68 at pivot 118 and to front swing link 64 at pivot 120. Front end 122 of tie bar 108 is pivotally connected at pivot 124 to front link 106 intermediate pivots 118, 120.

Upper coordinating linkage 74, in addition to upper link 86, generally includes crank 126 and tie bar 128. Crank 126 is pivotally connected to seat link 68 at pivot 130. Rear end 132 of upper link 86 is pivotally connected to crank 126 at pivot 134. Rear end 135 of tie bar 128 is pivotally connected to crank 126 at pivot 136, while front end 138 is connected to lower inside ottoman link 139 at pivot 140.

Ottoman linkage 72, which links ottoman cushion 72*a* to the chair, in addition to lower inside ottoman link 139, generally includes upper inside ottoman link 142, lower intermediate link 144, upper intermediate link 146, lower outside link 148, outer ottoman flange 150, and inner ottoman link 152. Lower inside ottoman link 139 is pivotally coupled to seat link 68 at pivot 154 and to upper intermediate link 146 at pivot 156. Upper inside ottoman link 142 is pivotally connected to seat link 68 at pivot 158, to upper intermediate link 146 at pivot 160, and to lower intermediate link 144 at pivot 162. Upper intermediate link 146 is pivotally connected to outer ottoman flange 150 at pivot 164 and lower intermediate link 144 is pivotally connected to outer ottoman flange 150 at pivot 166. Lower outside link 148 is pivotally connected to outer ottoman flange 150 at pivot 168 and to inner ottoman link 152 at pivot 170. Inner ottoman link 152 is pivotally connected to upper intermediate link 144 at pivot 172.

Backrest linkage 78, which links backrest cushion assembly 78*a* to the chair, generally includes yolk 174 and connecting link 176. Yolk 174 is pivotally connected to upper projecting portion 178 of seat link 68 at pivot 180, and to connecting link 176 at pivot 182. Lower end 184 of connecting link 176 is pivotally connected to bell crank 82 at pivot 186.

Drive linkage 76 generally includes crank 188 and connecting rod 190. Connecting rod 190 is pivotally connected to lower inside ottoman link 139 at pivot 192 and to crank 188 at pivot 194. Crank 188 defines aperture 196 for receiving crankshaft 60 therethough, and is rotationally fixed to crankshaft 60 with fastener 198. Bushing 199 extends through seat link 68 and rotationally receives crankshaft 60. Drive spring 200 extends between flange 202 on seat link 68 and slot 204 on connecting rod 190.

Seat box 56, which supports seat cushion assembly 56*a*, generally includes outer frame 250 which has a plurality of support wires 252 extending between front and back rails 254, 256, and side rails, 258, 260. Seat box 56 is fastened to seat link 68 at flanges 262, 264. Cross-bracing 58 extends between opposing flanges 266 on front swing links 64 of each linkage 52, 54, and opposing flanges 268 on rear swing links 66 of each linkage 52, 54, to complete the assembly of recliner mechanism 50.

Figure 8:
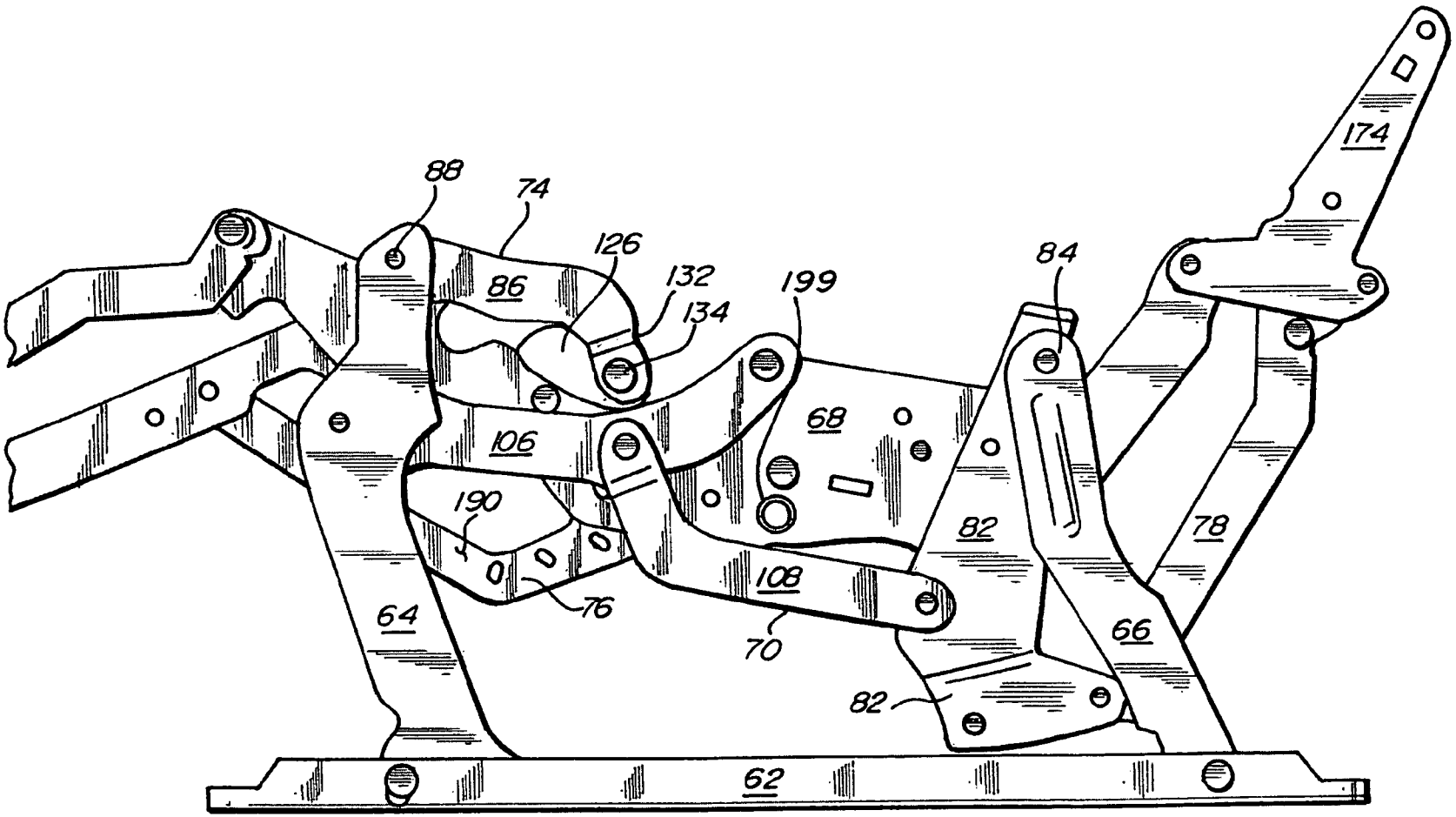
FIG. 8 is an outside elevation view of a linkage of the recliner mechanism of FIG. 1, positioned in a TV position.
Figure 9:
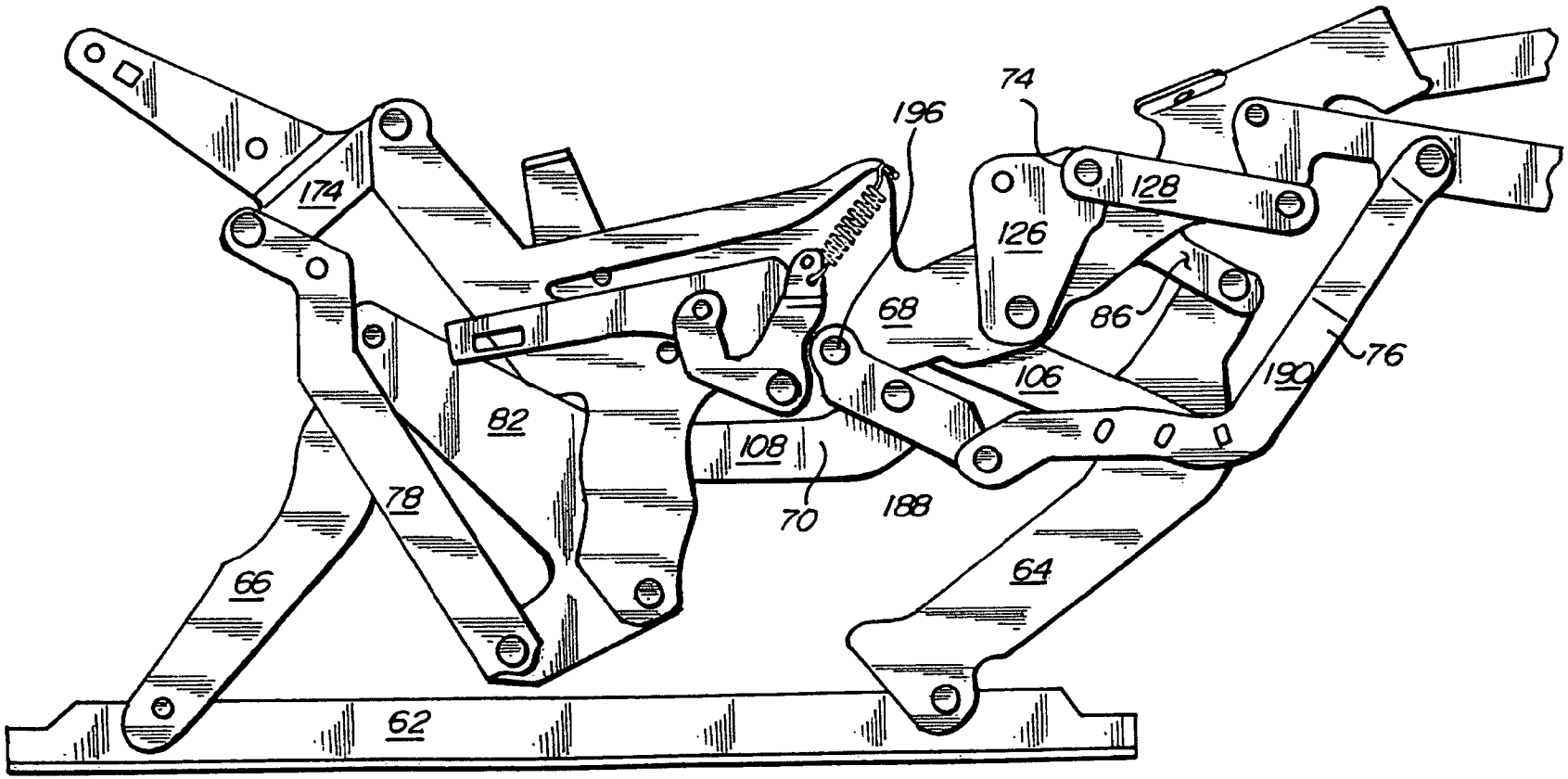
FIG. 9 is an inside elevation view of a linkage of the recliner mechanism of FIG. 1, positioned in a fully reclined position.
Figure 10:
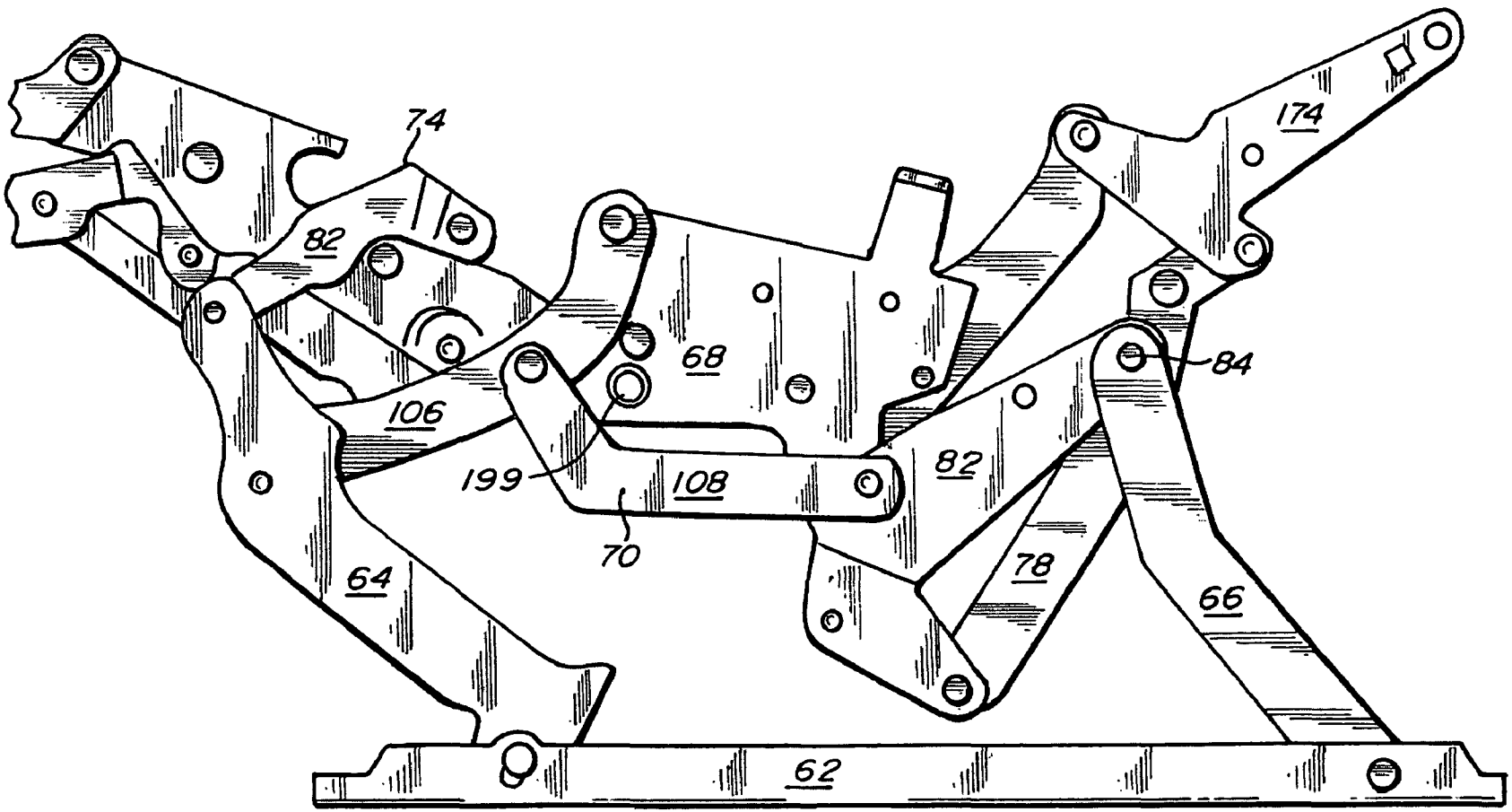
FIG. 10 is an outside elevation view of a linkage of the recliner mechanism of FIG. 1, positioned in a fully reclined position.
Figure 11:
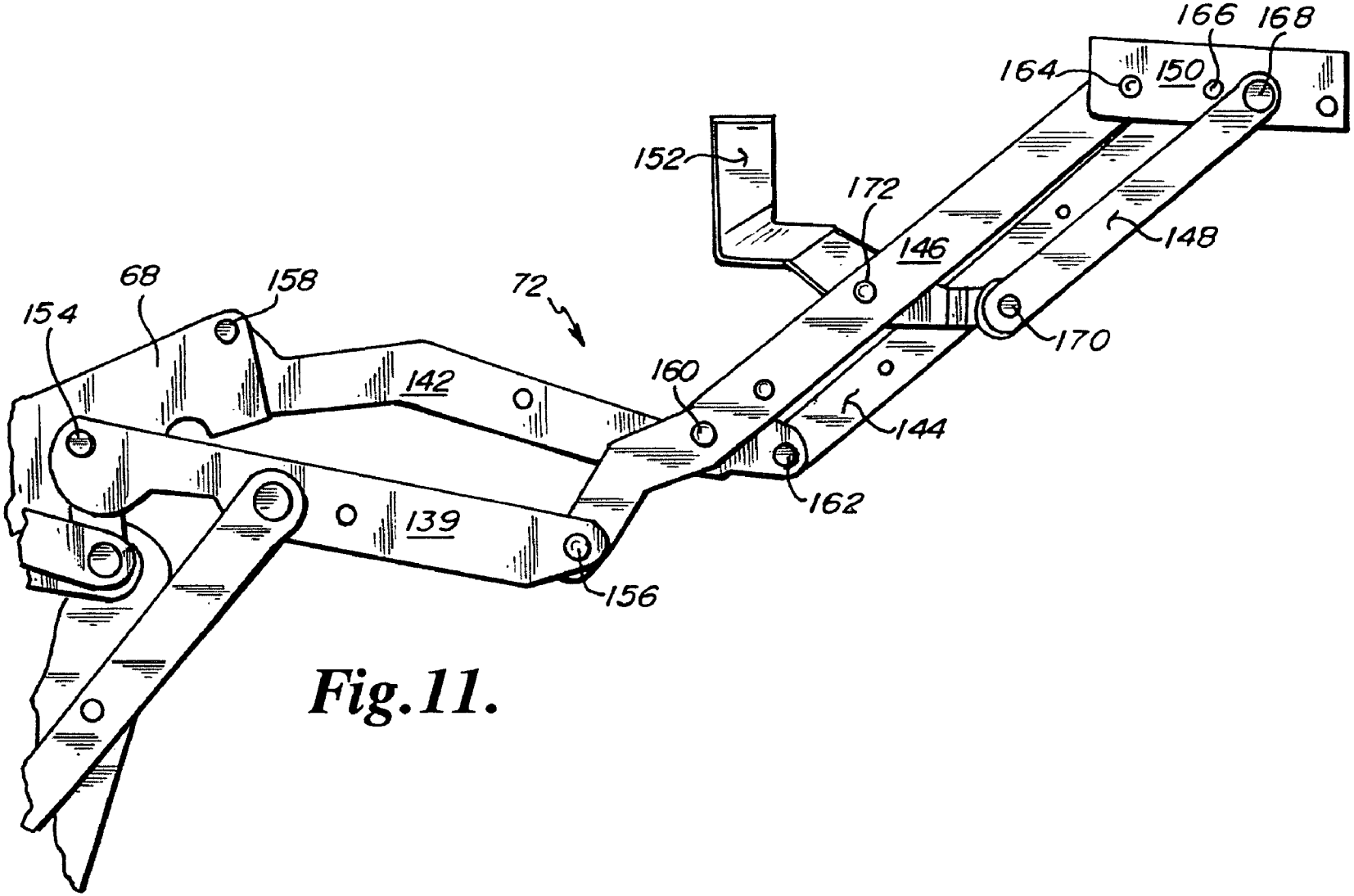
FIG. 11 is an elevation view of the ottoman mechanism of the recliner mechanism.
Figure 12:
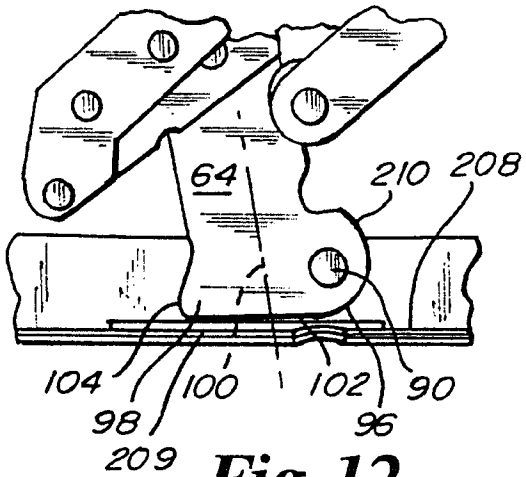
FIG. 12 is a fragmentary inside view of the bottom end of the front swing link of a linkage of the recliner mechanism of FIG. 1, positioned in an upright position.
Figure 13:
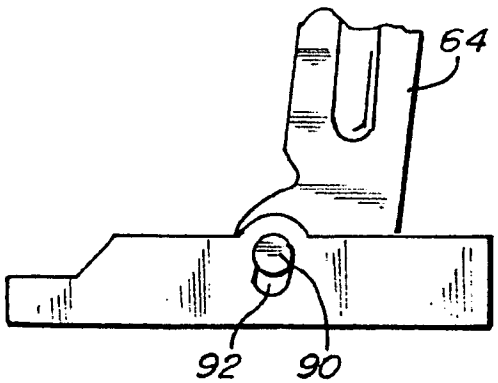
FIG. 13 is a fragmentary outside view of the bottom end of the front swing link of a linkage of the recliner mechanism of FIG. 1, positioned in an upright position.

In use, recliner mechanism 50 is selectively positionable in three discrete positions: (1) an upright position with ottoman retracted at depicted in FIGS. 1-6; (2) a "TV" position in which the ottoman is extended but the backrest remains upright at depicted in FIGS. 7-8; and (3) a fully reclined position in which the backrest is folded down and the ottoman is raised as depicted in FIGS. 9-10. In the upright position as depicted in FIGS. 1-6, crank 188 extends rearwardly on a line from crankshaft 60 that is slightly above a line extending along drive spring 200 such that drive linkage 76 is slightly "overcenter" and is held in position by the tension of drive spring 200. Trigger release mechanism 206 is operably coupled to a release lever located between an arm of the recliner and the seat cushion, or to any other release control as may be known in the recliner art. In the upright position, as depicted in FIGS. 12-13, follower post 90 is disposed in the upper end of slot 92 and bottom edge 102 of front swing link 64 proximate rounded corner 104 rests on bottom flange 208 of base link 62. A pad 209 made from elastomeric material may be interposed between bottom edge 102 and bottom flange 208 to prevent metal-to-metal contact.

Figure 7:
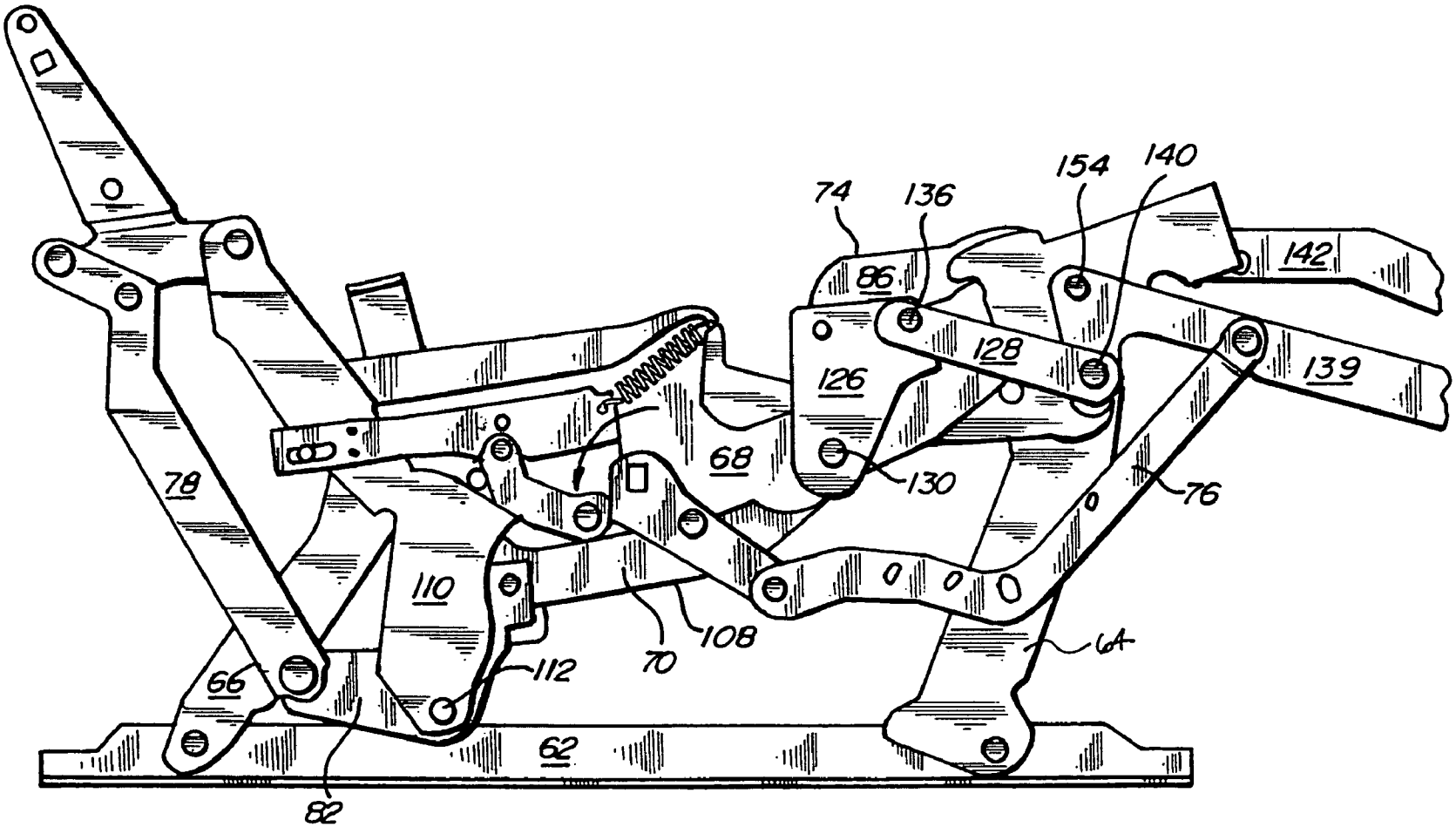
FIG. 7 is an inside elevation view of a linkage of the recliner mechanism of FIG. 1, positioned in a TV position.
Figure 14:
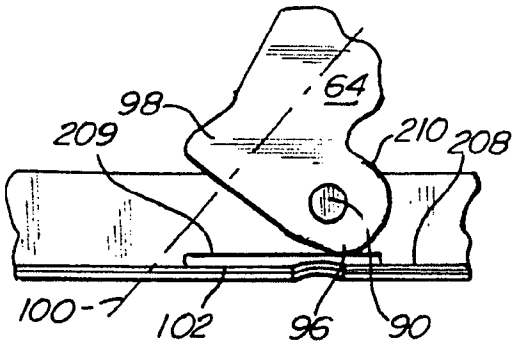
FIG. 14 is a fragmentary inside view of the bottom end of the front swing link of a linkage of the recliner mechanism of FIG. 1, positioned in a TV position.
Figure 16:
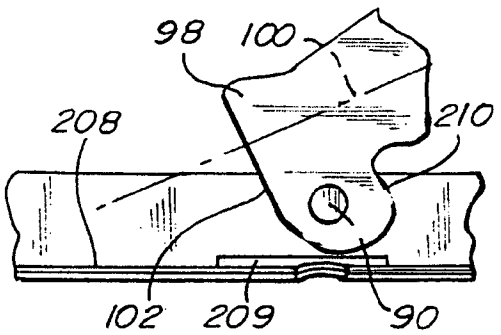
FIG. 16 is a fragmentary inside view of the bottom end of the front swing link of a linkage of the recliner mechanism of FIG. 1, positioned in a fully reclined position.
Figure 15:
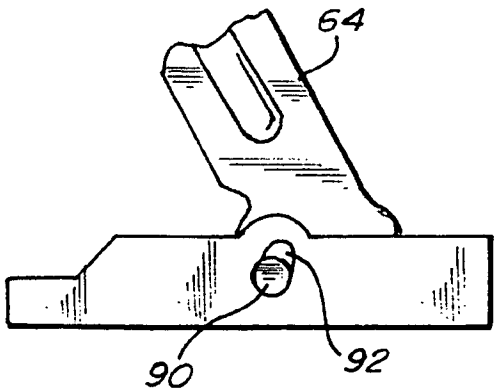
FIG. 15 is a fragmentary outside view of the bottom end of the front swing link of a linkage of the recliner mechanism of FIG. 1, positioned in a TV position.
Figure 17:
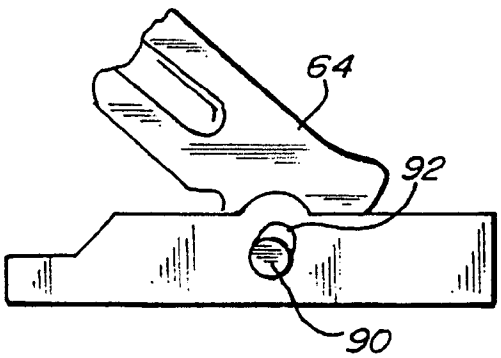
FIG. 17 is a fragmentary outside view of the bottom end of the front swing link of a linkage of the recliner mechanism of FIG. 1, positioned in a fully reclined position.
Figure 20:
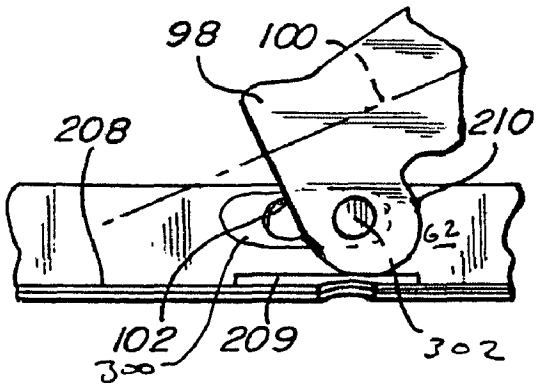
FIG. 20 is a fragmentary inside view of the bottom end of the front swing link of the embodiment of FIG. 18, positioned in a fully reclined position.
Figure 19:
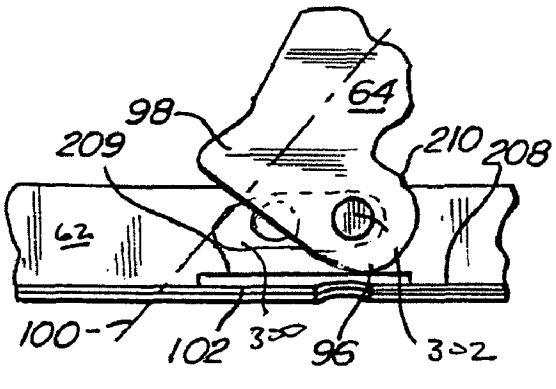
FIG. 19 is a fragmentary inside view of the bottom end of the front swing link of the embodiment of FIG. 18, positioned in a TV position.
Figure 18:
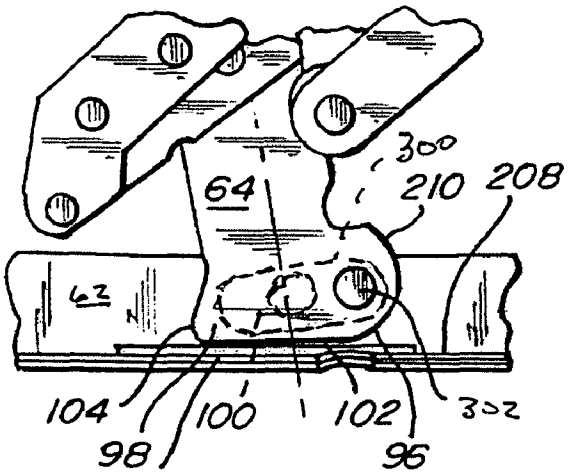
FIG. 18 is a fragmentary inside view of the bottom end of a front swing link of a linkage of a recliner mechanism according to an alternative embodiment of the invention, positioned in an upright position.
Figure 21:
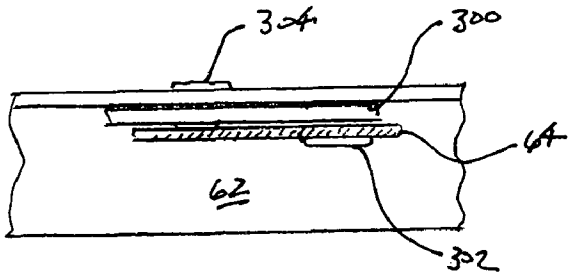
FIG. 21 is an top view of the linkage coupling the base link and front swing link of the embodiment of FIG. 18.

Upon activation of the release lever, crank 188 and crankshaft 60 rotate in the direction of the arrow as depicted in FIG. 7. Once crank 188 passes through center, drive spring 200 pulls connecting rod 190 forward, driving ottoman linkage 72 to extend. Front swing link 64 and rear swing link 66 rotate forward slightly, causing bottom edge 102 of front swing link 64 to rock on bottom flange 208 so that rounded front edge 210 is resting on bottom flange 208 is depicted in FIGS. 14-15. Follower 90, in turn, slides upwardly in slot 92. The rocking motion of bottom edge 102 of front swing link 64 enables the lower pivot point about which front swing link rotates relative to base link 62 to shift forward slightly, thereby enabling the backrest to shift forward slightly in turn.

In the embodiment depicted in FIGS. 1-17, slot 92 enables about 3/16 inch of vertical sliding movement of follower post 90. It will, however, be appreciated that the range of movement of follower post 90 may range between about 1/32 inch to 2 or more inches in embodiments of the invention.

As the recliner is shifted from the "TV" position depicted in FIGS. 7-8 and FIGS. 14-15, to the fully reclined position depicted in FIGS. 9-10 and FIGS. 16-17, seat link 68 shifts forwardly as enabled by lower coordinating linkage 70 and upper coordinating linkage 74. Bottom edge 102 rocks further forward along rounded front edge 210 as front swing link 64 pivots about follower post 90.

From the above description, it will be appreciated that the rocking motion of bottom edge 102 of front swing link 64 on bottom flange 208 enables the mechanism to shift forwardly by a greater degree with less user effort than prior zero-clearance mechanisms upon reclining, thereby reducing or eliminating any rearward movement of the top edge of the backrest and enabling the chair to be placed nearer the wall. It will be appreciated by those of ordinary skill that, in accordance with the invention, follower post 90 and slot 92 may be replaced by other mechanism elements enabling similar movement such as a bell crank or other linkage.

For instance, in an embodiment depicted in FIGS. 18-21, front swing link 64 is pivotally coupled to intermediate link 300 at pivot 302. Intermediate link 300 is, in turn, pivotally coupled to base link 62 at pivot 304. Again, bottom end 94 of front swing link 64 has offset portions 96, 98, on either side of longitudinal axis 100, with pivot 302 disposed on offset portion 96 so as to be offset from longitudinal axis 100. Bottom edge 102 of front swing link 64 has rounded corner 104 at the rear.

In use, rounded corner 104 rests bottom flange 208 when the chair is positioned in the upright position. As the chair is shifted from the upright position toward the reclined position, front swing link 64 pivots about pivot 302 relative to intermediate link 300. Bottom edge 102 of front swing link 64 rocks on bottom flange 208, shifting rounded corner 104 upward. Intermediate link 300 pivots about pivot 304 enabling pivot 302 to shift vertically as front swing link 64 rocks.

It will be appreciated by those of skill in the art that shifting of the pivotal coupling point between front swing link 64 and base link 62 may also be accomplished by mechanical linkages and connections of a variety of other configurations, all within the scope of the present invention. Accordingly, since the present invention may be embodied in other specific forms without departing from the spirit of the essential attributes thereof; the depicted embodiments should be considered in all respects as illustrative and not restrictive, reference being made to the appended claims rather than to the foregoing description to indicate the scope of the invention.

What is claimed is:

1. A reclining chair comprising:

a seat;

a backrest; and a pair of spaced apart recliner mechanisms cooperatively supporting the seat and backrest, each mechanism comprising:

a ground engaging base link;

a seat link operably coupled with and supporting the seat;

a backrest linkage operably coupling the backrest to the seat link;

a rear swing link operably coupled to the base link at a first pivot; and a front swing link operably coupled to the base link with a shiftable pivot mechanism defining a second pivot;

wherein the rear swing link and the front swing link are operably coupled to the seat link and the backrest linkage, wherein the rear swing link and the front swing link are selectively pivotable about the first and second pivots respectively to enable the mechanism to be selectively shifted between an upright position in which the seat is disposed in a first position relative to the base link and the backrest defines a first angle relative to the seat, and a reclined position in which the seat is disposed in a second position forward of the first position relative to the base link and the backrest defines a second angle greater than the first angle relative to the seat, wherein the shiftable pivot mechanism shifts a position of the second pivot in a substantially vertical direction relative to the base link as the mechanism shifts between the first position and the second position, and wherein the position of the first pivot relative to the base link does not shift as the mechanism shifts between the first position and the second position.

2. The reclining chair of claim 1, wherein the shiftable pivot mechanism comprises a follower post on the front swing link and a slot defined in the base link, the follower post received and slidably shiftable in the slot.

3. The reclining chair of claim 1, wherein the shiftable pivot mechanism comprises a linkage operably coupling the front link and the base link.

4. The reclining chair of claim 1, wherein each mechanism is positionable in a third position intermediate the first position and the second positions.

5. The reclining chair of claim 4, wherein the third position corresponds with a TV position.

6. The reclining chair of claim 1, wherein each mechanism further comprises an ottoman linkage operably coupled to the seat link, and wherein the ottoman linkage is selectively shiftable between a retracted position corresponding with the upright position of the mechanism, and an extended position corresponding with the reclined position of the mechanism.

7. The reclining chair of claim 6, wherein each mechanism further comprises a drive linkage operably coupled with the ottoman linkage for selectively shifting the ottoman linkage between the retracted position and the extended position.

8. The reclining chair of claim 6, further comprising a rotatable crank extending between the drive linkages of the pair of mechanisms.

9. A reclining chair comprising:

a seat;

a backrest; and a pair of spaced apart recliner mechanisms cooperatively supporting the seat and backrest, each mechanism comprising:

a ground engaging base link;

a seat link operably coupled with and supporting the seat;

a backrest linkage operably coupling the backrest to the seat link;

a rear swing link operably coupled to the base link at a first pivot;

a front swing link;

means for pivotally coupling the front swing link to the base link comprising:

means for defining a second pivot about which the front swing link is selectively pivotable; and means for shifting a position of the second pivot relative to the base link;

wherein the rear swing link and the front swing link are operably coupled to the seat link and the backrest linkage, wherein the rear swing link and the front swing link are selectively pivotable about the first and second pivots respectively to enable the mechanism to be selectively shifted between an upright position in which the seat is disposed in a first position relative to the base link and the backrest defines a first angle relative to the seat, and a reclined position in which the seat is disposed in a second position forward of the first position relative to the base link and the backrest defines a second angle greater than the first angle relative to the seat, wherein the position of the second pivot is shifted in a substantially vertical direction relative to the base link as the mechanism shifts between the first position and the second position, and wherein the position of the first pivot relative to the base link does not shift as the mechanism shifts between the first position and the second position.

10. The reclining chair of claim 9, wherein the means for defining a second pivot about which the front swing link is selectively pivotable comprises a follower post on the front swing link, and the means for shifting a position of the second pivot includes a slot defined in the base link, the follower post received and slidably shiftable in the slot.

11. The reclining chair of claim 9, wherein the means for defining a second pivot about which the front swing link is selectively pivotable and the means for shifting a position of the second pivot comprises a crank pivotally coupled to the base link and the front swing link.

12. The reclining chair of claim 9, wherein each mechanism is positionable in a third position intermediate the first position and the second positions.

13. The reclining chair of claim 12, wherein the third position corresponds with a TV position.

14. The reclining chair of claim 9, wherein each mechanism further comprises an ottoman linkage operably coupled to the seat link, and wherein the ottoman linkage is selectively shiftable between a retracted position corresponding with the upright position of the mechanism, and an extended position corresponding with the reclined position of the mechanism.

15. The reclining chair of claim 14, wherein each mechanism further comprises a drive linkage operably coupled with the ottoman linkage for selectively shifting the ottoman linkage between the retracted position and the extended position.

16. The reclining chair of claim 15, further comprising a rotatable crank extending between the drive linkages of the pair of mechanisms.

17. A zero-clearance mechanism for a reclining chair comprising:

a ground engaging base link;

a seat link;

a backrest linkage comprising a backrest bracket;

a rear swing link operably coupled to the base link at a first pivot; and a front swing link operably coupled to the base link with a shiftable pivot mechanism defining a second pivot;

wherein the rear swing link and the front swing link are operably coupled to the seat link and the backrest linkage, wherein the rear swing link and the front swing link are selectively pivotable about the first and second pivots respectively to enable the mechanism to be selectively shifted between an upright position in which the seat link is disposed in a first position relative to the base link and the backrest bracket defines a first angle relative to the seat, and a reclined position in which the seat link is disposed in a second position forward of the first position relative to the base link and the backrest bracket defines a second angle greater than the first angle relative to the seat link, wherein the shiftable pivot mechanism shifts a position of the second pivot in a substantially vertical direction relative to the base link as the mechanism shifts between the first position and the second position, and wherein the position of the first pivot relative to the base link does not shift as the mechanism shifts between the first position and the second position.

18. The reclining chair of claim 17, wherein the shiftable pivot mechanism comprises a follower post on the front swing link and a slot defined in the base link, the follower post received and slidably shiftable in the slot.

19. The reclining chair of claim 17, wherein the shiftable pivot mechanism comprises a linkage operably coupling the front link and the base link.

20. The reclining chair of claim 17, wherein the mechanism further comprises an ottoman linkage operably coupled to the seat link, and wherein the ottoman linkage is selectively shiftable between a retracted position corresponding with the upright position of the mechanism, and an extended position corresponding with the reclined position of the mechanism.

* * * * *